US012129139B2

(12) United States Patent
Tokonami

(10) Patent No.: US 12,129,139 B2
(45) Date of Patent: Oct. 29, 2024

(54) SHEET POST-PROCESSING APPARATUS AND IMAGE FORMING SYSTEM

(71) Applicant: KYOCERA Document Solutions Inc., Osaka (JP)

(72) Inventor: Minoru Tokonami, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 89 days.

(21) Appl. No.: 18/249,322

(22) PCT Filed: Oct. 20, 2021

(86) PCT No.: PCT/JP2021/038710
§ 371 (c)(1),
(2) Date: Apr. 17, 2023

(87) PCT Pub. No.: WO2022/085709
PCT Pub. Date: Apr. 28, 2022

(65) Prior Publication Data

US 2023/0416038 A1 Dec. 28, 2023

(30) Foreign Application Priority Data

Oct. 21, 2020 (JP) ..... 2020-176773

(51) Int. Cl.
*B65H 29/22* (2006.01)
*B65H 45/00* (2006.01)

(52) U.S. Cl.
CPC ..... *B65H 29/22* (2013.01); *B65H 45/00* (2013.01); *B65H 2404/1441* (2013.01); *B65H 2601/521* (2013.01); *B65H 2801/06* (2013.01)

(58) Field of Classification Search
CPC .. B65H 2301/164; B65H 29/22; B65H 45/00; B65H 2404/1441; B65H 2801/06; G03G 2215/00877; G03G 15/6582
See application file for complete search history.

(56) References Cited

U.S. PATENT DOCUMENTS 6,102,385 A * 8/2000 Wakamatsu ..... B65H 31/34 270/58.08

FOREIGN PATENT DOCUMENTS

JP 2013060255 A * 4/2013
JP 2013086938 A * 5/2013

* cited by examiner

*Primary Examiner* — Jennifer Bahls
(74) *Attorney, Agent, or Firm* — Studebaker & Brackett PC

(57) ABSTRACT

A sheet post-processing apparatus (1) includes a processing tray (5), a sheet discharge port (7), a conveyance rollers pair (4), lower and upper discharge rollers (81), (82) and a discharge tray (9). When the sheet having a folded portion is stacked on the processing tray (5) with the folded portion downward, a controller rotates the lower and upper discharge rollers (81), (82) to advance the folded portion to the sheet discharge port (7), stops the lower discharge roller (81) before the folded portion passes the sheet discharge port (7), rotates the conveyance rollers pair (4) and the upper discharge roller (82) so as to convey the rear half portion to the downstream side until the sheet passes the conveyance rollers pair (4) and to form a deflection on the sheet, rotates the lower and upper conveyance rollers (81), (82) and then to stack the sheet on the processing tray (5).

5 Claims, 11 Drawing Sheets

SHEET POST-PROCESSING APPARATUS AND IMAGE FORMING SYSTEM

TECHNICAL FIELD

The present invention relates to a sheet post-processing apparatus of an image forming apparatus and an image forming system including the sheet post-processing apparatus.

BACKGROUND

A sheet post-processing apparatus is known, which is performable a post-processing such as a staple processing and a punching processing on a sheet on which an image is formed. For example, the sheet post-processing apparatus includes a processing tray on which the predetermined processing is performed on the sheet, a sheet discharge port disposed on the downstream side of the processing tray in the sheet discharge direction, and a discharge tray disposed below the sheet discharge port and on the downstream side of the sheet discharge port in the sheet discharge direction.

In some cases, a sheet having a downward Z-shaped folded portion as viewed from the sheet width direction perpendicular to the sheet discharge direction at the downstream portion of the sheet in the sheet discharge direction is conveyed to the processing tray of the sheet post-processing apparatus. At this time, in the sheet post-processing apparatus, the Z-shaped folded portion of the sheet may temporarily protrude outside the sheet discharge port in the middle of the operation of conveying the sheet to the processing tray. As a result, a part of the sheet is caught in the sheet discharge port, and the sheet cannot be conveyed to a predetermined position on the processing tray. An example of the prior art in which such a problem has been solved is disclosed in Patent Document 1.

A conventional sheet post-processing apparatus disclosed in Patent literature 1 includes a first conveyance rollers pair, a second conveyance rollers pair which can be brought into contact with each other and separate from each other, and disposed on the downstream side of the first conveyance rollers pair in the conveyance direction, and a stacking part positioned between the rollers pairs. In a case in which the sheet folded in a Z-shape with the folded portion facing downward is conveyed, after the folded portion of the sheet is nipped by the second conveyance rollers pair in a stopped state and the tail end of the sheet passes through the first conveyance rollers pair, the second conveyance rollers pair are separated away each other to stack the sheet on the stacking part. Thus, it becomes possible to stack the sheet on the stacking part without catching the folded portion of the sheet on the second conveyance rollers pair.

PRIOR ART DOCUMENTS

Patent Document

[Patent Document 1] Japanese Patent Laid-Open No. 2013-60255

SUMMARY OF THE INVENTION

Problems to be Solved by the Invention

In the prior art, the sheet is deflected between the first conveyance rollers pair and the second conveyance rollers pair. Then, the tail end of the sheet is pressed against the rotating first conveyance rollers pair owing to the elasticity of the deflection when the sheet passes through the first conveyance rollers pair. As a result, noise is generated and there is a problem that the stacking of sheet on the stacking part may become unstable.

In view of the above problem, it is an object of the present invention to provide a sheet post-processing apparatus capable of suppressing the generation of noise and improving the stability of stacked sheets on the processing tray and an image forming system.

Means of Solving the Problems

In order to achieve the above purpose, a sheet post-processing apparatus according to the present invention includes: a processing tray on which a sheet is stacked and a predetermined processing is performed on the sheet; a sheet discharge port disposed on a downstream side of the processing tray in a sheet discharge direction; a conveyance rollers pair disposed on an upstream side of the sheet discharge port in the sheet discharge direction; a lower discharge roller and an upper discharge roller which are disposed in the sheet discharge port, rotate independently from each other, and have circumferential surfaces bringing into contact with each other to form a nip area; a discharge tray disposed below a downstream side of the sheet discharge port in the sheet discharge direction; and a controller controlling an operation of the conveyance rollers pair, the lower discharge roller and the upper discharge roller, wherein when the sheet having a folded portion formed by folding a front half portion of the sheet in the sheet discharge direction downward in a Z-shape is stacked on the processing tray with the folded portion downward, the controller rotates the lower discharge roller and the upper discharge roller in a normal direction to advance the folded portion of the sheet conveyed by the conveyance rollers pair to the sheet discharge port, stops rotation of the lower discharge roller before an upstream end of the folded portion in the sheet discharge direction passes through the sheet discharge port, rotates the conveyance rollers pair and the upper discharge roller forward in a state where the upstream end of the folded portion in the sheet discharge direction is nipped between the lower discharge roller and the upper discharge roller so as to slide a rear half portion of the sheet on the folded portion in the nip area, to convey the rear half portion to the downstream side in the sheet discharge direction until an upstream end of the sheet in the sheet conveyance direction passes through the conveyance rollers pair and to form a deflection on the sheet, and then rotates the lower conveyance roller and the upper conveyance roller reversely to convey the sheet to the upstream side in the sheet conveyance direction and then to stack the sheet on the processing tray.

Effects of the Invention

According to the configuration of the present invention, the sheet is deflected on the downstream side of the sheet discharge port in the sheet discharge direction. Accordingly, it becomes possible to prevent the upstream end of the sheet in the sheet discharge direction from pressing against the rotating conveyance rollers pair when the upstream end of the sheet passes through the conveyance rollers pair. As a result, it becomes possible to suppress the generation of noise and to improve the stability of stacked sheets on the processing tray.

EMBODIMENT FOR CARRYING OUT THE INVENTION

Hereinafter, with reference to the drawings, one embodiment of the present invention will be described. The present invention is not limited to the following description.

Figure 1:
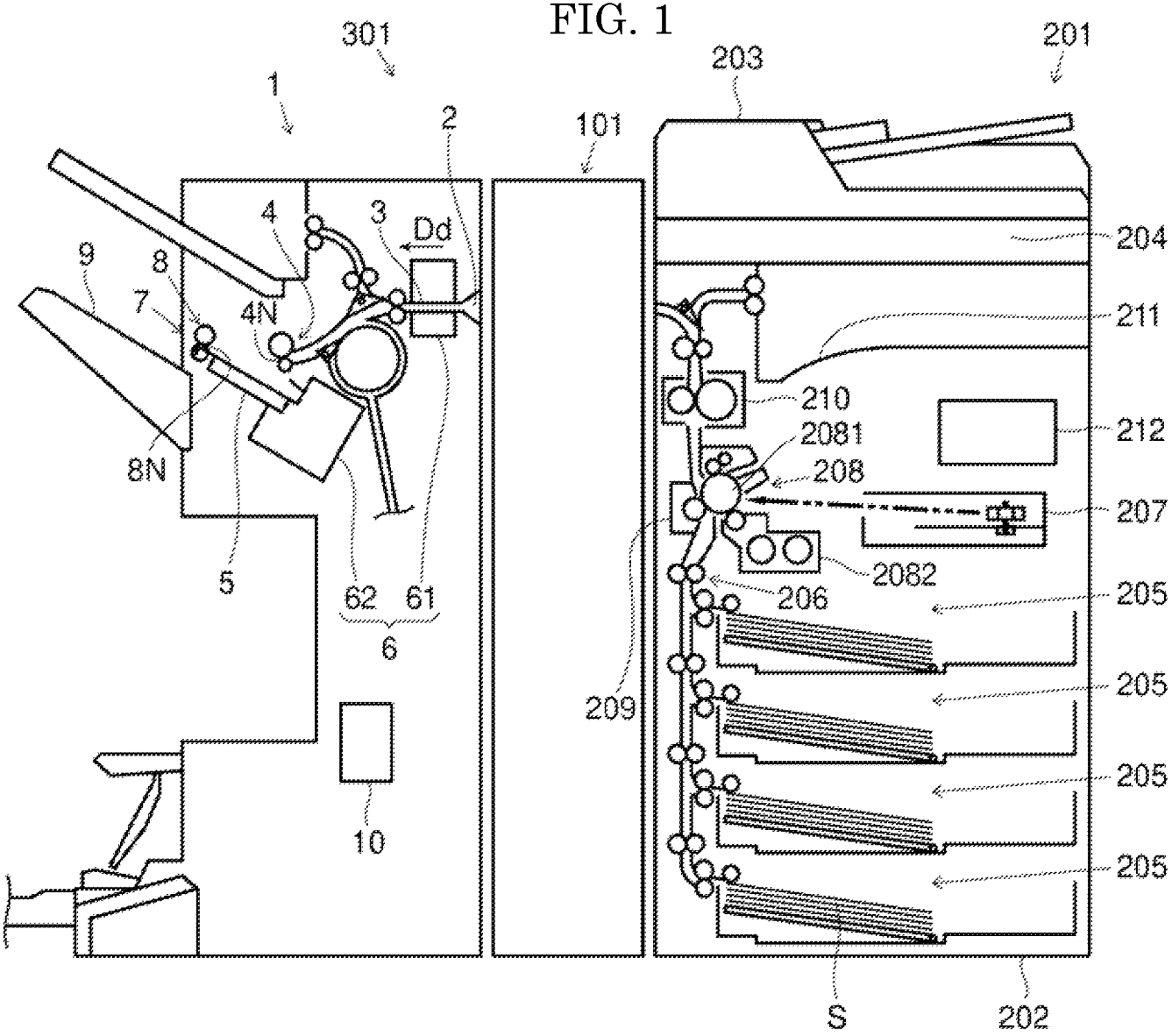
FIG. 1 is a sectional front view schematically showing a structure of an image forming system according to one embodiment of the present invention.

FIG. 1 is a partial front sectional view schematically showing a structure of an image forming system 301 according to the embodiment of the present invention. As shown in FIG. 1, the image forming system 301 includes an image forming apparatus 201, a Z-folding apparatus 101, and a sheet post-processing apparatus 1.

The image forming apparatus 201 is a so-called monochrome multifunctional peripheral having functions such as printing, scanning (image reading), and facsimile transmission, for example. The image forming apparatus 201 may be a copying machine, a printer or the like, or a color multifunctional peripheral, for example.

As shown in FIG. 1, the image forming apparatus 201 includes a document conveyance part 203 mounted on the upper surface of the main body 202 and an image reading part 204 provided in the main body 202 below the document conveyance part 203. The image of the document placed on the document conveyance part 203 or the image of the document placed on the contact glass (not shown) on the upper surface of the image reading part 204 is read by the image reading part 204.

The image forming apparatus 201 further includes a sheet feeding part 205, a sheet conveyance part 206, an exposure part 207, an image forming part 208, a transfer part 209, a fixing part 210, a sheet discharge part 211, and a main body controller 212.

The sheet feeding part 205 stores a plurality of sheets S before printing, separates the sheets S one by one and then feeds it at the time of printing. The sheet conveyance part 206 conveys the sheet S fed from the sheet feeding part 205 to the transfer part 209 and the fixing part 210, and further distributes the sheet S after fixing to the sheet discharge part 211 or the Z-folding apparatus 101. The exposure part 207 emits laser light controlled based on image data to the image forming part 208.

The image forming part 208 includes a photosensitive drum 2081 as an image carrier and a development device 2082. In the image forming part 208, an electrostatic latent image of the document image is formed on the surface of the photosensitive drum 2081 by the laser light emitted from the exposure part 207. The development device 2082 supplies toner to the electrostatic latent image on the surface of the photosensitive drum 2081 and develops it to form a toner image. The transfer part 209 transfers the toner image on the surface of the photosensitive drum 2081 to the sheet S. The fixing part 210 heats and pressurizes the sheet S on which the toner image is transferred to fix the toner image on the sheet S.

The sheet S on which the toner image is fixed and the printing is performed is conveyed to the sheet discharge part 211 or the Z-folding apparatus 101. The sheet discharge part 211 is disposed below the image reading part 204. The sheet discharge part 211 has a front opening, and the printed sheet (the printed matter) is taken out through the front face side.

The main body controller 212 includes a CPU, an image processing unit, a storage unit, and other electronic circuits and electronic components (they are not shown). The CPU controls the operation of each component provided in the image forming apparatus 201 based on the control program and data stored in the storage unit to perform processing related to the function of the image forming apparatus 201. Each of the sheet feeding part 205, the sheet conveyance part 206, the exposure part 207, the image forming part 208, the transfer part 209, and the fixing part 210 receives an individual command from the main body controller 212, and performs the printing on the sheet S in cooperation with each other. The storage unit is composed of a combination of a nonvolatile storage device such as a program ROM (Read Only Memory) or a data ROM (not shown) and a volatile storage device such as a RAM (Random Access Memory).

According to the above-described structure, the image forming apparatus 201 forms the image on the sheet S and conveys the sheet S on which the image is formed to the Z-folding apparatus 101.

The Z-folding apparatus 101 is detachably coupled to the side surface of the image forming apparatus 201. The Z-folding apparatus 101 performs a Z-folding processing on the sheet after the image forming (the printing) is performed in the image forming apparatus 201.

Figure 2:
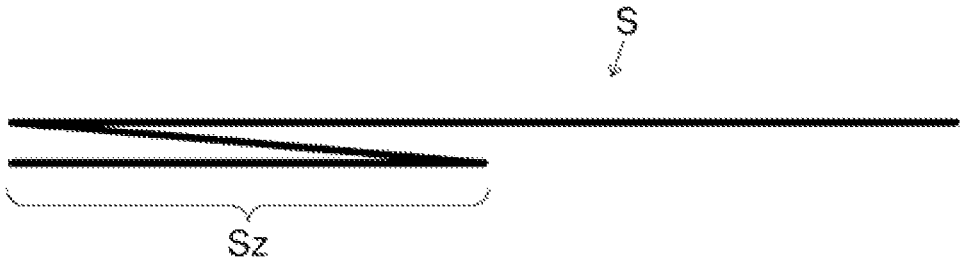
FIG. 2 is a front view schematically showing a sheet with a Z-shaped folded portion.

FIG. 2 is a front view schematically showing a sheet S with a Z-shaped folded portion Sz. The Z-folding apparatus 101 forms the Z-shaped folded portion Sz facing downward, when viewed from a sheet width direction perpendicular to the sheet discharge direction, on the downstream portion of the sheet S in the sheet discharge direction.

The sheet post-processing apparatus 1 is detachably coupled to the side surface of the Z-folding apparatus 101. The sheet post-processing apparatus 1 performs a post-processing on the sheet S on which the image formation (the printing) is performed in the image forming apparatus 201 and the Z-shaped folded portion Sz is formed in the Z-folding apparatus 101.

Figure 3:
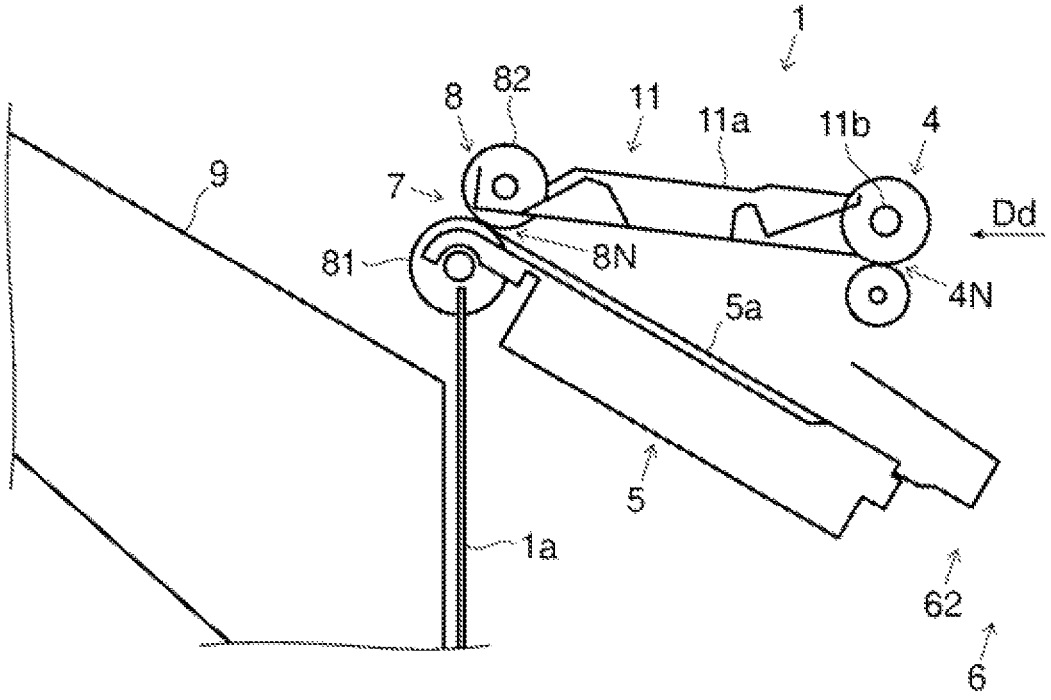
FIG. 3 is a partial sectional front view showing a processing tray of a sheet post-processing apparatus shown in FIG. 1 and its periphery.

Next, the configuration of the sheet post-processing apparatus 1 will be described. FIG. 3 is a partial sectional front view showing a processing tray 5 of the sheet post-processing apparatus 1 shown in FIG. 1 and its periphery. In the following description of the sheet post-processing apparatus 1, the direction from the right side to the left side in FIG. 1 and FIG. 3 is referred to as the "sheet discharge direction", and it is shown as the arrow Dd in FIG. 3 and below. With respect to the sheet discharge direction Dd, the right side relative to the left side in FIG. 1 and FIG. 3 is the "upstream side" or the "rear side" of the sheet discharge direction Dd, and the left side relative to the right side in FIG. 1 and FIG. 3 is the "downstream side" or the "front side" of the sheet discharge direction Dd. In addition, the "sheet width direction" perpendicular to the sheet discharge direction Dd is a direction perpendicular to the paper plane of FIG. 1 and FIG. 3, and is also a direction perpendicular to the paper plane in FIG. 4 and below.

As shown in FIG. 1 and FIG. 3, the sheet post-processing apparatus 1 includes a sheet carry-in port 2, a sheet discharge path 3, an intermediate rollers pair (a conveyance rollers pair) 4, a processing tray 5, a post-processing part 6, a sheet discharge port 7, a discharge rollers pair 8, a discharge tray 9, and a post-processing controller (a controller) 10.

The sheet carry-in port 2 is provided on the side surface of the sheet post-processing apparatus 1 facing the Z-folding apparatus 101 and is opened. The sheet S conveyed from the Z-folding apparatus 101 toward the sheet post-processing apparatus 1 is carried in the sheet post-processing apparatus 1 through the sheet carry-in port 2.

The sheet discharge path 3 extends horizontally from the sheet carry-in port 2 to above the processing tray 5 in a direction away from the image forming apparatus 201 (the left direction in FIG. 1). The sheet carry-in port 2 is positioned at the upstream end of the sheet discharge path 3 in the sheet discharge direction Dd.

The intermediate rollers pair (the conveyance rollers pair) 4 is disposed on the sheet discharge path 3 on the downstream side of a punching part 61, described later, in the sheet discharge direction Dd. The intermediate rollers pair 4 is disposed on the upstream side of the sheet discharge port 7 in the sheet discharge direction Dd. The rotational shafts of the intermediate rollers pair 4 extend along the sheet width direction. A plurality of the intermediate rollers pairs 4 is provided at intervals along the sheet width direction. The intermediate rollers pair 4 sends out the sheet S conveyed along the sheet discharge path 3 toward the sheet discharge port 7 provided on the downstream side in the sheet discharge direction Dd.

The processing tray 5 is disposed below the downstream portion of the sheet discharge path 3 in the sheet discharge direction Dd. In other words, the processing tray is positioned just below the downstream side of the intermediate rollers pair 4 in the sheet discharge direction Dd. The sheet placement surface 5*a* of the processing tray is inclined upward toward the downstream side in the sheet discharge direction Dd. On the processing tray 5, the sheets S conveyed along the sheet discharge path 3 are stacked, and a predetermined processing is performed on the sheets S.

The post-processing part 6 performs the predetermined processing on the sheet S conveyed along the sheet discharge path 3. The post-processing part 6 includes the punching part 61 and a stapling part 62.

The punching part 61 is disposed between the sheet carry-in port 2 and the downstream end of the sheet discharge path 3. The sheet post-processing apparatus 1 can perform a punching processing on the sheet S conveyed along the sheet discharge path 3 using the punching part 61 to form a punched hole in the sheet S.

The stapling part 62 is disposed on the upstream side of the processing tray 5 in the sheet discharge direction Dd. The sheet post-processing apparatus 1 can perform a stapling processing (a binding processing) on a stack of the sheets stacked on the processing tray 5 using the stapling part 62 to bind the sheet stack.

The sheet discharge port 7 is disposed on the downstream side of the intermediate rollers pair 4 in the sheet discharge direction Dd and on the downstream side of the processing tray 5 in the sheet discharge direction Dd. The discharge rollers pair 8 is disposed in the sheet discharge port 7. The sheet S on which the predetermined processing is performed on the processing tray 5 is discharged toward the discharge tray 9 through the sheet discharge port 7.

The discharge rollers pair 8 is disposed in the sheet discharge port 7. The discharge rollers pair 8 discharges the sheet S on the processing tray 5 in the sheet discharge direction Dd. Further, the discharge rollers pair 8 discharges the sheet S to the discharge tray 9 through the sheet discharge port 7. The rotational shafts of the discharge rollers pair 8 extend along the sheet width direction. A plurality (for example, two) of the discharge rollers pairs 8 is provided at intervals along the sheet width direction. The discharge rollers pair 8 includes a lower discharge roller 81 and an upper discharge roller 82.

The lower discharge roller 81 and the upper discharge roller 82 are disposed in the sheet discharge port 7. The lower discharge roller 81 and the upper discharge roller 82 are connected to a discharge roller drive part (not shown) and rotate independently from each other. The lower discharge roller 81 and the upper discharge roller 82 are capable of rotating in a normal rotation for discharging the sheet S to the discharge tray 9 and in a reverse direction (reversely) for feeding the sheet S to the processing tray 5.

The upper discharge roller 82 is supported by a contact/separation mechanism 11. The contact/separation mechanism 11 has an arm part 11*a*. The arm part 11*a* extends along the sheet discharge direction Dd and rotatably supports the upper discharge roller 82 at the downstream end portion in the sheet discharge direction Dd.

The arm part 11*a* is supported by the sheet post-processing apparatus 1 so as to be turnable around a rotational shaft 11*b* extending along the sheet width direction at the upstream end portion in the sheet discharge direction Dd. The arm part 11*a* is connected to an arm drive part (not shown), and is turned upward and downward around the rotational shaft 11*b* with the downstream end portion supporting the upper discharge roller 82 as a free end.

The contact/separation mechanism 11 turns the arm part 11*a* to causes the lower discharge roller 81 and the upper discharge roller 82 to bring them into contact with each other and to separate them away. Specifically, the upper discharge roller 82 comes into contact with and separates from the lower discharge roller 81. The circumference surfaces of the lower discharge roller 81 and the upper discharge roller 82 are brought into contact with each other to form a nip area 8N. The lower discharge roller 81 and the upper discharge roller 82 convey the sheet S nipped in the nip area 8N.

The discharge tray 9 is disposed below the downstream side of the sheet discharge port 7 in the sheet discharge direction Dd. The sheet placement surface 9*a* of the discharge tray 9 is inclined upward toward the downstream side in the sheet discharge direction Dd. The upstream end of the discharge tray 9 in the sheet discharge direction Dd is positioned below the sheet discharge port 7. A sheet receiving wall 1*a* is provided on the upstream side of the sheet discharge tray 9 in the sheet discharge direction Dd. The sheet receiving wall 1*a* extends in a substantially vertical direction and the sheet width direction.

The discharge tray 9 can be moved substantially in the vertical direction along the upper-and-lower direction by a tray drive part (not shown). The sheet S discharged through the sheet discharge port 7 by the discharge rollers pair 8 is stacked on the discharge tray 9. The discharge tray 9 is one of the final discharge places of the sheet S in the sheet post-processing apparatus 1.

The post-processing controller (a controller) 10 includes a CPU, an image processing unit, a storage unit, and other electronic circuits and electronic components (not shown). The post-processing controller 10 is communicatively connected to the main body controller 212. The post-processing controller 10 receives a command from the main body controller 212, controls the operation of each component provided in the sheet post-processing apparatus 1 based on the control program and data stored in the storage unit using the CPU, and performs processing related to the functions of the sheet post-processing apparatus 1. Each of the sheet discharge path 3, the intermediate rollers pair 4, the processing tray 5, the post-processing part 6, the discharge rollers pair 8, and the discharge tray 9 receives a command individually from the post-processing controller and performs the post-processing on the sheet S in cooperation with each other. The post-processing controller is an example of the "controller" of the present invention, and the main body controller 212 may have the function of the "controller".

The sheet S discharged through the sheet discharge port 7 by the rotating the discharge rollers pair 8 in the normal direction (forward) is stacked on the discharge tray 9. Further, in a state where the sheet S is nipped in the nip area 8N of the discharge rollers pair 8 and the upstream end of the sheet S in the sheet discharge direction Dd is separated away from the nip area 4N of the intermediate rollers pair 4, when the discharge rollers pair 8 is rotated in the reverse direction, the sheet S is conveyed to the processing tray 5. That is, when the sheet S is to be conveyed to the processing tray 5, the post-processing controller 10 switches back the sheet S after the leading end of the sheet S in the sheet discharge direction Dd passes through the sheet discharge port 7, and conveys the sheet S to the processing tray 5.

Figure 4:
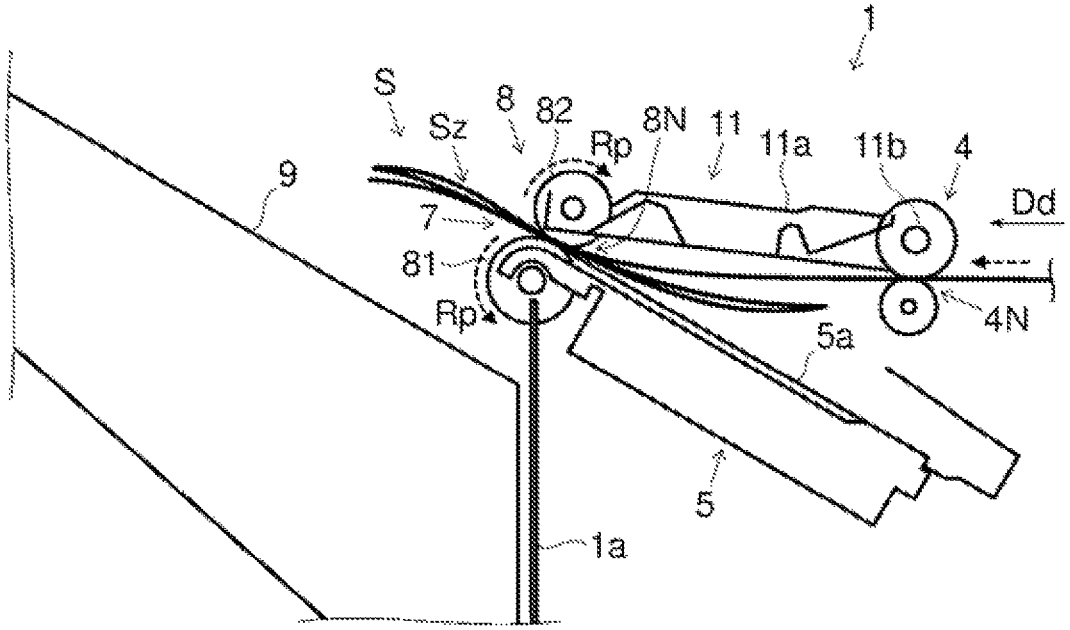
FIG. 4 is a partial sectional front view showing the processing tray shown in FIG. 2 and its periphery in a state where the sheet with the Z-shaped folded portion reaches a sheet discharge port.
Figure 5:
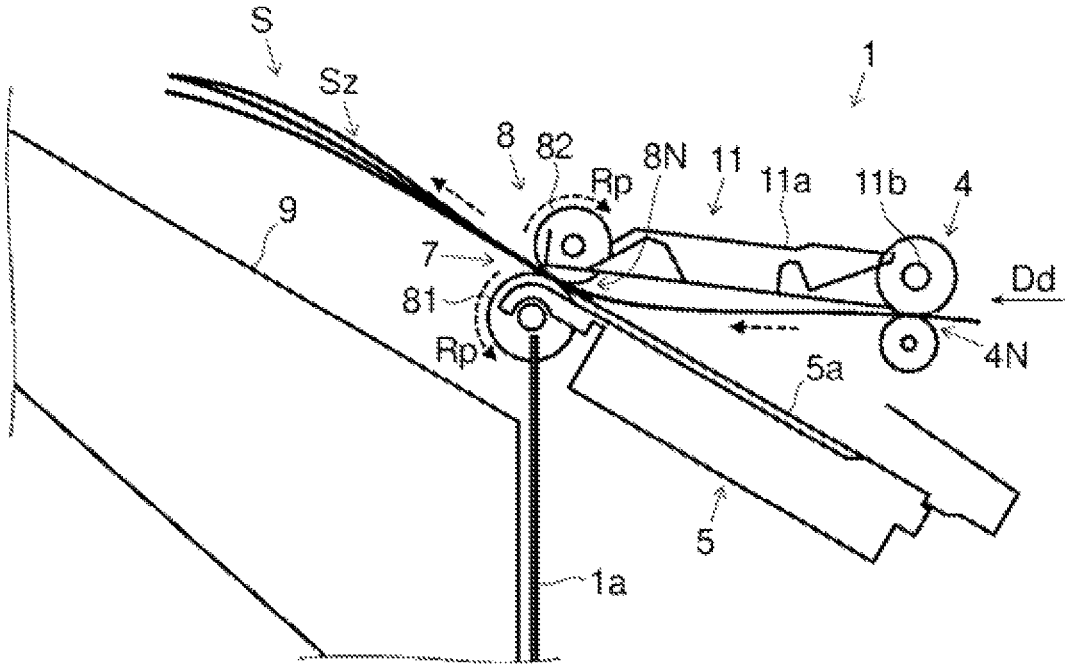
FIG. 5 is a partial sectional front view showing the processing tray in FIG. 2 and its periphery in a state where most of the Z-shaped folded portion is conveyed to the downstream side in the sheet discharge direction from the sheet discharge port.

Next, a detailed operation of the sheet post-processing apparatus 1 will be described. FIG. 4 is a partial sectional front view showing the processing tray 5 shown in FIG. 2 and its periphery in a state in which the sheet S having the Z-shaped folded portion Sz reaches the sheet discharge port 7. FIG. 5 is a partial sectional front view showing the processing tray 5 shown in FIG. 2 and its periphery in a state in which most of the Z-shaped folded portion Sz are conveyed through the sheet discharge port 7 to the downstream side in the sheet discharge direction Dd. The Z-shaped folded portion Sz is also called a front half portion of the sheet S, and the upstream side portion of the folded portion Sz in the sheet discharge direction Dd is called a rear half portion.

The post-processing controller 10 controls the operation described below when the sheet S in which the front half portion of the sheet S in the sheet discharge direction Dd is the Z-shaped folded portion Sz facing downward, when viewed from the sheet width direction perpendicular to the sheet discharge direction Dd, is stacked on the processing tray 5. Whether the sheet S to be stacked on the processing tray 5 is the sheet S having the Z-shaped folded portion Sz is recognized by the post-processing controller 10 from the information of the command relating to the post-processing received from the main body controller 212. Further, the post-processing controller 10 measures the timing of rotation and stop of each roller and the timing of turning and stop of the contact/separation mechanism 11 using the rotation amount, the turning amount, and the time.

As shown in FIG. 4, the Z-shaped folded portion Sz of the sheet S passes through the intermediate rollers pair 4 and then advances to the sheet discharge port 7. At this time, the post-processing controller 10 causes the lower discharge roller 81 and the upper discharge roller 82 to rotate in the normal direction Rp such that the sheet S conveyed by the intermediate rollers pair 4 advances into the sheet discharge port 7.

Further, as shown in FIG. 5, the post-processing controller 10 conveys the sheet S to the downstream side in the sheet discharge direction Dd until just before the upstream end of the folded portion Sz in the sheet discharge direction Dd passes through the sheet discharge port 7. The post-processing controller 10 stops the rotation of the lower discharge roller 81 before the upstream end of the folded portion Sz in the sheet discharge direction Dd passes through the sheet discharge port 7.

Figure 6:
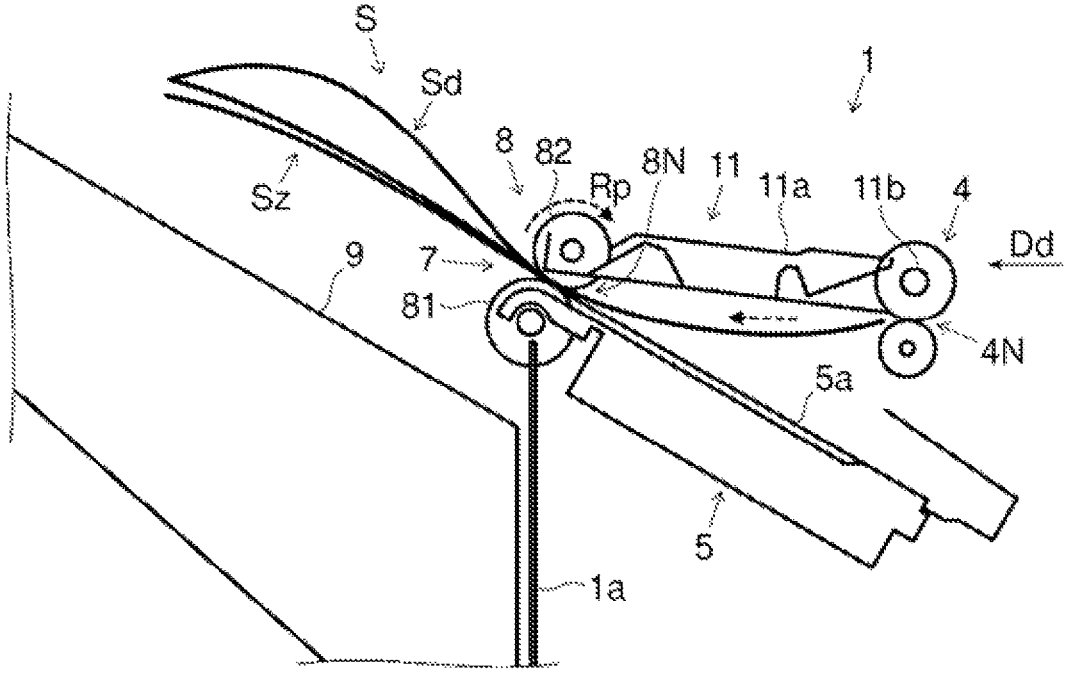
FIG. 6 is a partial sectional front view showing the processing tray in the first embodiment and its periphery in a state where the upstream portion of the sheet on the upstream side of the Z-shaped folded portion in the sheet discharge direction is conveyed.
Figure 7:
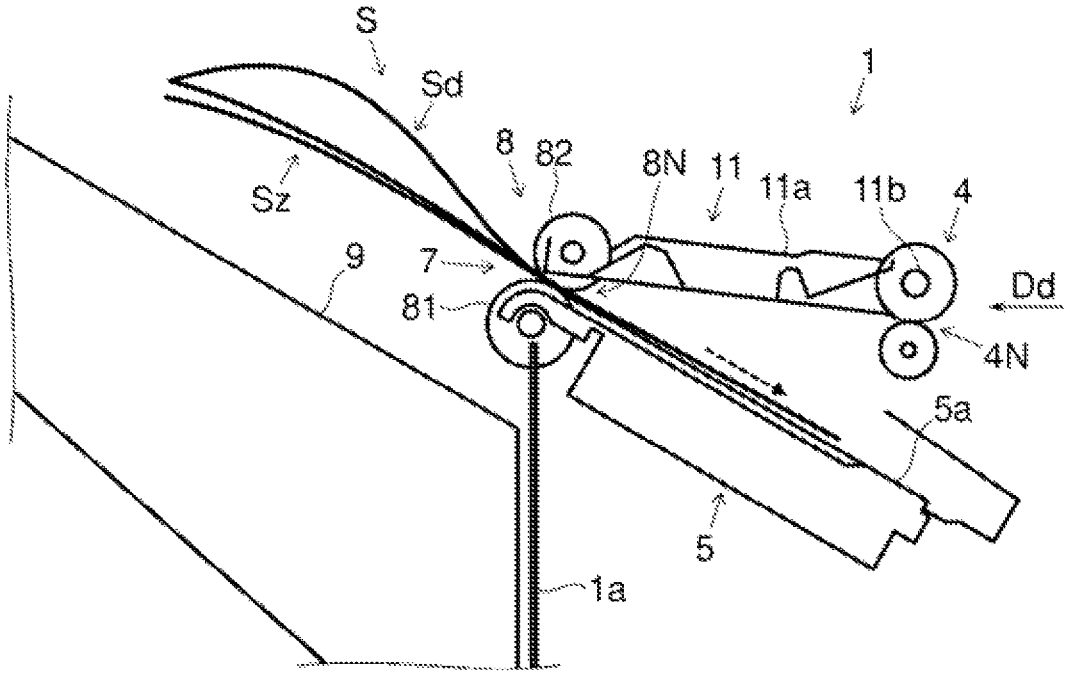
FIG. 7 is a partial sectional front view showing the processing tray in the first embodiment and its periphery in a state where the sheet passed a conveyance rollers pair is conveyed to the processing tray.

FIG. 6 is a partial sectional front view showing the processing tray 5 according to the first embodiment and its periphery in a state in which the upstream portion of the sheet S on the upstream side of the Z-shaped folded portion Sz in the sheet discharge direction Dd is conveyed. FIG. 7 is a partial sectional front view showing the processing tray 5 according to the first embodiment and its periphery in a state in which the sheet S passed through the intermediate rollers pair 4 is conveyed toward the processing tray 5.

After stopping the rotation of the lower discharge roller 81 before the upstream end of the folding portion Sz in the sheet discharge direction Dd passes through the sheet discharge port 7, as shown in FIG. 6, the post-processing controller 10 rotates only the upper discharge roller 82 in the normal direction Rp in a state where the upstream end of the folded portion Sz in the sheet discharge direction Dd is positioned on the lower discharge roller 81. Next, the post-processing controller 10 conveys the rear half portion of the sheet S in the sheet discharge direction Dd to the downstream side in the sheet discharge direction Dd until the upstream end of the sheet S (the rear half portion) in the sheet discharge direction Dd passes through the intermediate rollers pair 4. As a result, a deflection Sd shown in FIG. 6 is generated in the upper portion of the folded portion Sz of the sheet S.

After the rear half portion of the sheet S in the sheet discharge direction Db is conveyed to the downstream side in the sheet discharge direction Dd until the upstream end of the sheet S in the sheet discharge direction Dd passes through the intermediate rollers pair 4, the post-processing controller 10 rotates the lower discharge roller 81 and the upper discharge roller 82 in the reverse direction. Then, the post-processing controller 10 conveys the sheet S to the upstream side in the sheet discharge direction Dd and stacks the sheet S on the processing tray 5 (see FIG. 7).

According to the above configuration, the deflection Sd is generated in the sheet S on the downstream side of the sheet discharge port 7 in the sheet discharge direction Dd. Therefore, it is possible to prevent the sheet from being pressed against the rotating intermediate rollers pair 4 when the upstream end of the sheet S in the sheet discharge direction Dd passes through the intermediate rollers pair 4. Thus, the generation of the abnormal noise is suppressed, and the stability of stacking of the sheets S on the processing tray 5 can be improved.

Next, a detailed operation after the sheet S is conveyed to the downstream side in the sheet discharge direction Dd until the upstream end of the sheet S in the sheet discharge direction Dd passes through the intermediate rollers pair 4 will be described with reference to the second embodiment and the third embodiment.

Figure 8:
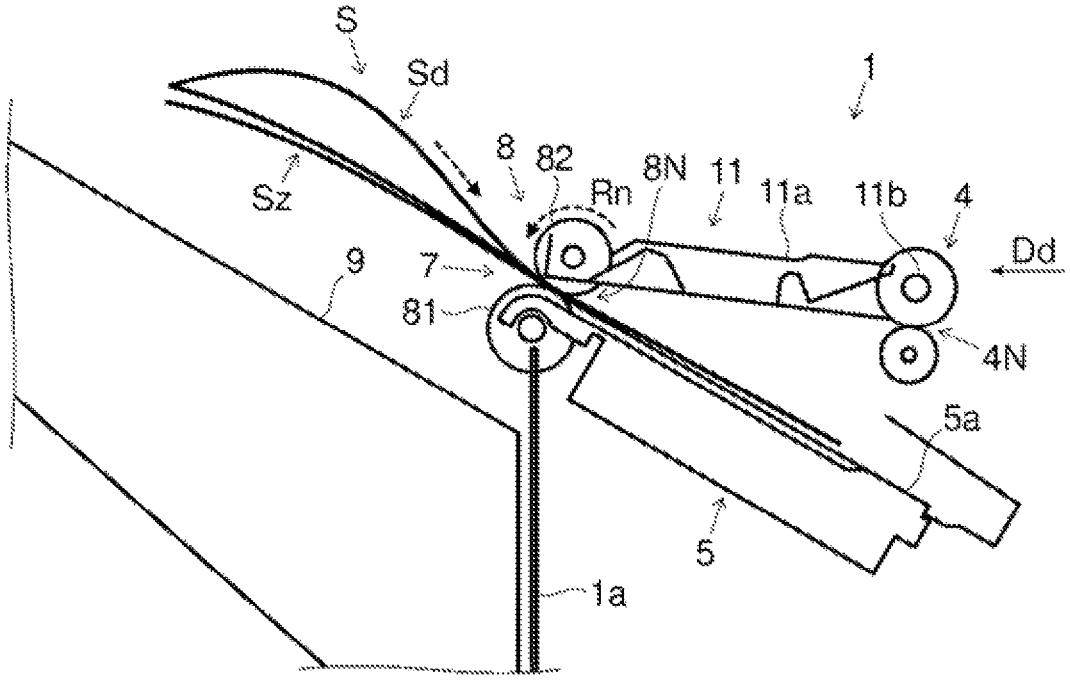
FIG. 8 is a partial sectional front view showing the processing tray in the second embodiment and its periphery in a state where the deflection of the sheet is eliminated.
Figure 9:
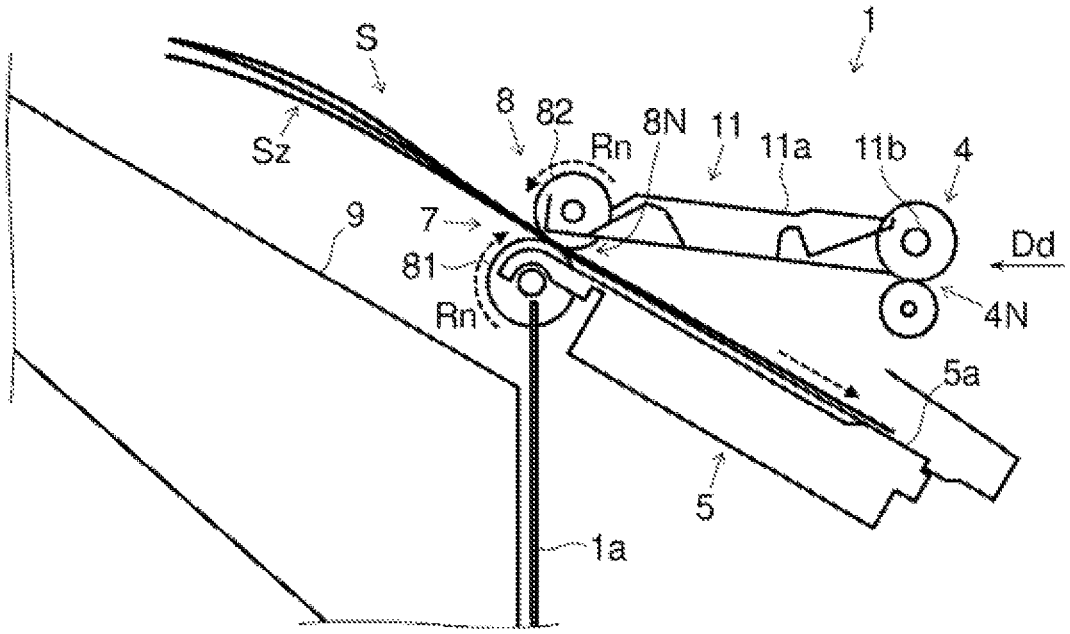
FIG. 9 is a partial sectional front view showing the processing tray in the second embodiment and its periphery in a state where the sheet whose deflection is eliminated is conveyed to the processing tray.

FIG. 8 is a partial sectional front view showing the processing tray 5 according to the second embodiment and its periphery in a state in which the deflection Sd of the sheet S is being eliminated. FIG. 9 is a partial sectional front view showing the processing tray 5 according to the second embodiment and its periphery in state in which the sheet S in which the deflection Sd is eliminated is conveyed toward the processing tray 5.

As shown in FIG. 8, after the upstream end of the sheet S in the sheet discharge direction Dd passes through the intermediate rollers pair 4, the post-processing controller 10 rotates the upper discharge roller 82 only in the reverse direction Rn for the same period as the period in which the rotation of the lower discharge roller 81 is stopped to convey the rear half portion of the sheet S in the sheet discharge direction Dd to the upstream side in the sheet discharge direction Dd.

That is, the rear half portion of the sheet S in the sheet discharge direction Dd in contact with the upper discharge roller 82 is conveyed to the upstream side in the sheet discharge direction Dd. The front half portion of the sheet S in the sheet discharge direction Dc, which is not in contact with the upper discharge roller 82, is not displaced. As a result, as shown in FIG. 9, the deflection Sd (see FIG. 8) generated on the upper portion of the folded portion Sz of the sheet S is eliminated.

After rotating the upper discharge roller 82 only in the reverse direction Rn to convey the rear half portion of the sheet S to the upstream side in the sheet discharge direction Dd, as shown in FIG. 9, the post-processing controller 10 rotates the lower discharge roller 81 and the upper discharge roller 82 together in the reverse direction Rn. That is, after rotating only the upper discharge roller 82 in the reverse direction Rn to eliminate the deflection Sd, the post-processing controller 10 rotates the lower discharge roller 81 and the upper discharge roller 82 together in the reverse direction Rn to convey the entire of the sheet S to the upstream side in the discharge direction Dd. The post-processing controller 10 conveys the sheet S to the upstream side in the sheet discharge direction Dd and then stacks it on the processing tray 5.

According to the above configuration, by rotating the upper discharge roller 82 in the reverse direction Rn, it becomes possible to eliminate the deflection Sd on the upper portion of the folded portion Sz. That is, the deflection Sd can be eliminated by utilizing the rotation of the upper discharge roller 82, and the folded portion Sz can be suitably made flat.

Figure 10:
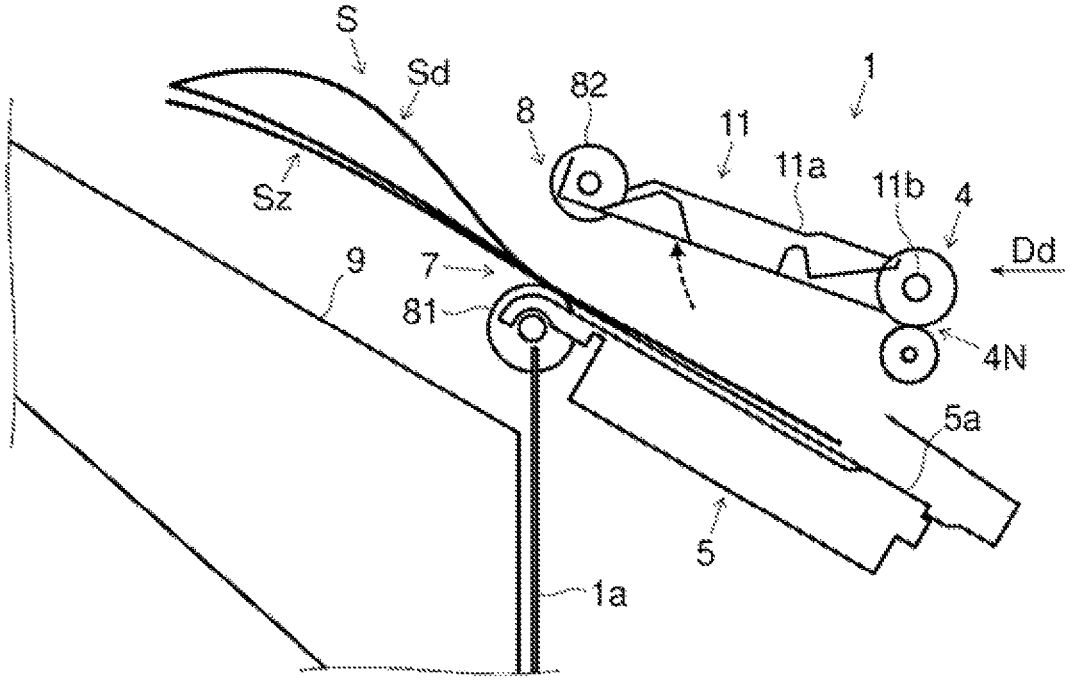
FIG. 10 is a partially sectional front view showing the processing tray in the third embodiment and its periphery in a state where the deflection of the sheet is corrected.
Figure 11:
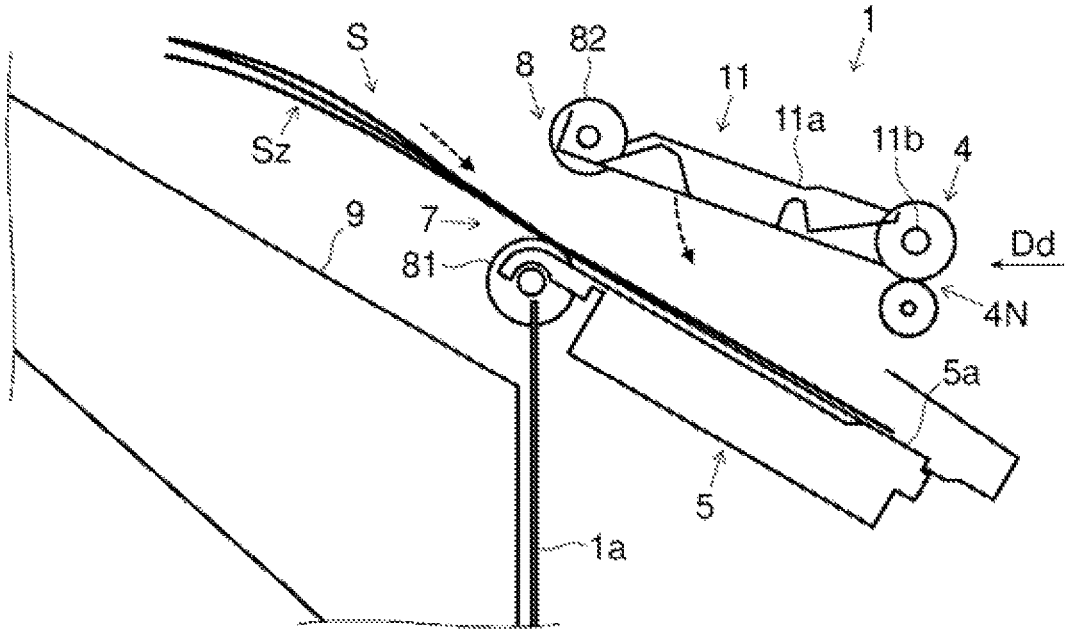
FIG. 11 is a partial sectional front view showing the processing tray in the third embodiment and its periphery in a state where the sheet whose deflection is eliminated is conveyed to the processing tray.

FIG. 10 is a partial sectional front view showing the processing tray 5 according to the third embodiment and its periphery in a state in which the deflection Sd of the sheet S is being eliminated. FIG. 11 is a partial sectional front view showing the processing tray 5 according to the third embodiment and its periphery in a state in which the sheet S in which the deflection Sd is eliminated is conveyed toward the processing tray 5.

After the upstream end of the sheet S in the sheet discharge direction Dd passes through the intermediate rollers pair 4, the post-processing controller 10 controls the contact/separation mechanism 11. As shown in FIG. 10, the post-processing controller 10 controls the contact/separation mechanism 11 such that the lower discharge roller 81 and the upper discharge roller 82 are separated away temporarily.

Specifically, the post-processing controller 10 controls the contact/separation mechanism 11 so as to lift the end portion of the arm part 11*a* supporting the upper discharge roller 82 and to separate the upper discharge roller 82 away from the lower discharge roller 81. As a result, as shown in FIG. 11, the upper portion of the folded portion Sz and the upstream portion on the upstream side of the folded portion Sz in the sheet discharge direction Dd are shifted to the upstream side in the sheet discharge direction Dd by its elastic force. That is, the deflection Sd (see FIG. 10) on the upper portion of the folded portion Sz of the sheet S is eliminated.

Next, the post-processing controller 10 controls the contact/separation mechanism 11 such that the upper discharge roller 82 brings into contact with the lower discharge roller 81 again. The sheet S is nipped in the nip area 8N formed by bringing the lower discharge roller 81 and the upper discharge roller 82 into contact with each other. Then, the post-processing controller 10 rotates the lower discharge roller 81 and the upper discharge roller 82 together in the reverse direction, conveys the sheet S to the upstream side in the sheet discharge direction Dd, and then stacks the sheet S on the processing tray 5.

According to the above configuration, by temporarily separating the lower discharge roller 81 from the upper discharge roller 82, the deflection Sd on the upper portion of the folded portion Sz can be eliminated. That is, the deflection Sd can be eliminated by utilizing the elastic force of the sheet S, and the folded portion Sz can be easily made flat without using power.

Further, according to the above configuration, since the image forming system 301 includes the sheet post-processing apparatus 1, the Z-folding apparatus 101, and the image forming apparatus 201, the image forming system 301 can prevent the sheet S from being pressed against the rotating intermediate rollers pair 4 when the upstream end of the sheet S in the sheet discharge direction Dd passes through the intermediate rollers pair 4. Thus, in the image forming system 301, the generation of abnormal noise is suppressed, and the stability of stacking of the sheets S on the processing tray 5 can be improved.

Although the embodiments of the present invention have been described above, the scope of the present invention is not limited thereto, and various modifications may be made without departing from the spirit of the invention.

For example, in the above embodiment, the image forming apparatus 201 of the image forming system 301 is an image forming apparatus for monochrome printing, but it is not limited to such a model. The image forming apparatus may be an image forming apparatus for color printing, for example.

INDUSTRIAL AVAILABILITY

The present invention is applicable to a sheet post-processing apparatus of an image forming apparatus and an image forming system including the sheet post-processing apparatus.

The invention claimed is:

1. A sheet post-processing apparatus comprising:

a processing tray on which a sheet is stacked and a predetermined processing is performed on the sheet;

a sheet discharge port disposed on a downstream side of the processing tray in a sheet discharge direction;

a conveyance rollers pair disposed on an upstream side of the sheet discharge port in the sheet discharge direction;

a lower discharge roller and an upper discharge roller which are disposed in the sheet discharge port, rotate independently from each other, and have circumferential surfaces bringing into contact with each other to form a nip area;

a discharge tray disposed below a downstream side of the sheet discharge port in the sheet discharge direction; and a controller controlling an operation of the conveyance rollers pair, the lower discharge roller and the upper discharge roller, wherein when the sheet having a folded portion formed by folding a front half portion of the sheet in the sheet discharge direction downward in a Z-shape is stacked on the processing tray with the folded portion downward, the controller rotates the lower discharge roller and the upper discharge roller in a normal direction to advance the folded portion of the sheet conveyed by the conveyance rollers pair to the sheet discharge port, stops rotation of the lower discharge roller before an upstream end of the folded portion in the sheet discharge direction passes through the sheet discharge port, rotates the conveyance rollers pair and the upper discharge roller forward in a state where the upstream end of the folded portion in the sheet discharge direction is nipped between the lower discharge roller and the upper discharge roller so as to slide a rear half portion of the sheet on the folded portion in the nip area, to convey the rear half portion to the downstream side in the sheet discharge direction until an upstream end of the sheet in the sheet conveyance direction passes through the conveyance rollers pair and to form a deflection on the sheet, and then rotates the lower conveyance roller and the upper conveyance roller reversely to convey the sheet to the upstream side in the sheet conveyance direction and then to stack the sheet on the processing tray.

2. The sheet post-processing apparatus according to claim 1, wherein the controller rotates only the upper discharge roller for the same period as a period in which the rotation of the lower discharge roller is stopped after the upstream end of the rear half portion of the sheet in the sheet discharge direction passes the conveyance rollers pair, so as to slide the rear half portion of the sheet on the folded portion in the nip area, to convey the rear half portion to the upstream side in the sheet discharge direction, and to eliminate the deflection, and then rotates the lower discharge roller and the upper discharge roller together in the reverse direction to convey the sheet to the upstream side in the sheet discharge direction, and then stacks the sheet on the processing tray.

3. The sheet post-processing apparatus according to claim 1, further comprising a contact/separation mechanism which brings the lower discharge roller and the upper discharge roller into contact with each other and separates them away from each other, wherein after the upstream end of the rear half portion of the sheet in the sheet discharge direction passes through the conveyance rollers pair, the controller controls the contact/separation part so as to separate the upper discharge roller from the lower discharge roller temporarily to release the nip area, and to bring the upper discharge roller into contact with the lower discharge roller again to form the nip area, rotates the lower discharge roller and the upper discharge roller together in the reverse direction to convey the sheet to the upstream side in the sheet discharge direction, and then stacks the sheet on the processing tray.

4. The sheet post-processing apparatus according to claim 3, wherein the conveyance rollers pair includes a lower conveyance roller and an upper conveyance roller in which circumferential surfaces thereof are in contact with each other to form a nip area, the contact/separation mechanism has an arm part that can be turned upward and downward around a rotational axis of the upper conveyance roller, and the upper discharge roller is rotatably supported by a downstream end of the arm part in the sheet discharge direction.

5. An image forming system comprising:

the sheet post-processing apparatus according to claim 1;

a Z-folding apparatus coupled to the sheet post-processing apparatus, forming the Z-shaped folded portion on the sheet, and conveying the folded sheet to the sheet post-processing apparatus; and an image forming apparatus coupled to the Z-folding apparatus, forming an image on the sheet, and then conveying the sheet after the sheet on which the image is formed to the Z-folding apparatus.

* * * * *